US006062922A

United States Patent [19]

Nanami

[11] Patent Number: 6,062,922

[45] Date of Patent: May 16, 2000

[54] WATERCRAFT PROPULSION SYSTEM

[75] Inventor: Masayoshi Nanami, Iwata, Japan

[73] Assignee: Yamaha Hatsudoki Kabushiki Kaisha, Iwata, Japan

[21] Appl. No.: 09/183,308

[22] Filed: Oct. 30, 1998

[51] Int. Cl.[7] ..... B63H 11/00

[52] U.S. Cl. ..... 440/38; 440/47

[58] Field of Search ..... 440/38, 46, 47, 440/75, 83

[56] References Cited

U.S. PATENT DOCUMENTS 3,387,583 6/1968 Kuether ..... 440/46
3,590,764 7/1971 Hunt ..... 440/38
5,123,867 6/1992 Broinowski ..... 440/38

*Primary Examiner*—Stephen Avila
*Attorney, Agent, or Firm*—Knobbe, Martens, Olson & Bear LLP

[57] ABSTRACT

A jet propulsion system for a watercraft wherein the jet propulsion outer housing has the impeller shaft portion in which the impeller is journaled for rotation about an impeller shaft axis disposed at an angle to the discharge nozzle rather than concentric with it as previously utilized. This permits the appropriate trim angle for the discharge nozzle while, at the same time, permitting the engine to be mounted relatively high in the hull so as to afford adequate clearance on the underside of the engine for such things as increasing the oil capacity for four cycle wet sump engines are employed.

14 Claims, 4 Drawing Sheets

WATERCRAFT PROPULSION SYSTEM

BACKGROUND OF THE INVENTION

This invention relates to a watercraft propulsion system and more particularly to an improved jet propulsion unit and driving arrangement therefor for such watercraft.

The use of so-called "jet propulsion units" is highly advantageous in watercraft, particularly a type of watercraft known as a "personal watercraft," although the use is not so limited. The advantage of the jet propulsion unit is that it can be concealed within the hull of the watercraft, and also it permits operation in very shallow water.

These jet propulsion units operate by drawing water from the body of water in which the watercraft is operating by an impeller that is driven by a prime mover generally mounted in the hull of the watercraft. The water is then discharged rearwardly through a discharge nozzle so as to provide a propulsive force for the watercraft. By mounting a pivotally supported steering nozzle in communication with the jet propulsion unit discharge nozzle, it is also possible to redirect the spray to the right or left and thus effect steering of the watercraft.

In connection with these jet propulsion units, generally the impeller shaft and the discharge nozzle are coaxial. It is important, however, to mount the discharge nozzle so that it has a relatively shallow angle to the horizontal, if any, to avoid providing either a lifting force or a porpoising force on the watercraft during its travel through the body of water. Because of the aforenoted coaxial relation of the impeller shaft and discharge nozzle axes, the angle of the discharge nozzle generally dictates the angle of the impeller shaft. Since the impeller shaft is generally driven by a direct drive from an engine output shaft, this also affects the actual mounting position of the engine in the watercraft hull. This is not particularly desirable for some reasons which will be discussed later.

It is, therefore, a principle object of this invention to provide a water jet propulsion unit for a watercraft wherein the discharge nozzle is maintained at the appropriate angle for the desired hull effect, but the impeller shaft for driving the impeller is positioned at a different angle to optimize the engine location.

One reason why the engine location in the hull is important is that it is desirable to maintain a relatively low center of gravity for the engine. However, the normal impeller shaft angle can result in too low an engine mounting. This presents a problem in connection with four cycle engines of the type that employ wet sump crankcases. The low mounting of the engine may not afford adequate oil capacity for use with a wet sump engine. Of course, it is possible to use dry sump engines, but they become more complex and costly.

It is, therefore, a still further object of this invention to provide an improved jet propulsion system for a watercraft wherein the engine can be mounted in the watercraft at a height that affords adequate oil capacity for a wet sump engine and yet wherein the discharge nozzle of the jet propulsion unit is disposed at the appropriate angle relative to the hull to provide the desired trim or hull effect.

SUMMARY OF THE INVENTION

This invention is adapted to be embodied in a jet propulsion unit for powering a watercraft. The jet propulsion unit includes an outer housing having an impeller portion in which an impeller rotates about an impeller shaft axis. The housing also defines a discharge nozzle to the rear of the impeller portion through which the pumped water is discharged for propelling the watercraft. In accordance with one feature of the invention, the angle of the center of the discharge nozzle and the axis of rotation of the impeller shaft are not parallel or coaxial.

Another feature of the invention is adapted to be embodied in a jet propelled watercraft having a jet propulsion unit comprised of an outer housing having an impeller portion in which an impeller rotates about an impeller shaft axis and a discharge nozzle portion to the rear of the impeller portion through which the pumped water is discharged for propelling the associated watercraft. An engine is positioned forwardly of the jet propulsion unit and has an output shaft that drives the impeller shaft through a transmission. The impeller shaft axis and the discharge nozzle axis are disposed so that the impeller shaft axis extends upwardly toward the front of the watercraft relative to the discharge nozzle axis.

DETAILED DESCRIPTION OF THE PREFERRED EMBODIMENT OF THE INVENTION

Figure 1:
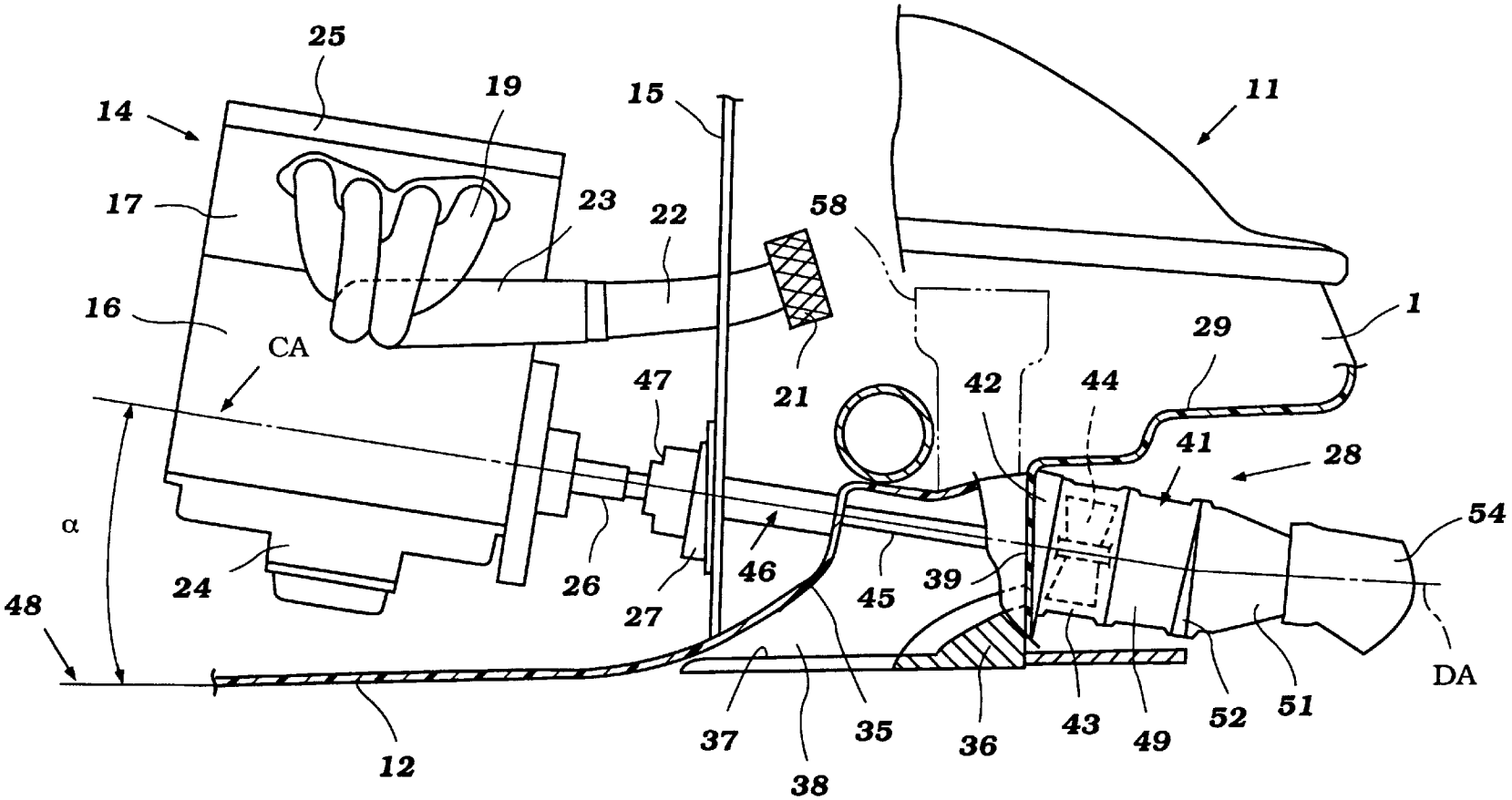
FIG. 1 is a partial cross-sectional view taken through the rear portion of the hull of a watercraft powered by propulsion units constructed in accordance with an embodiment of the invention.

Referring now in detail to the drawings, a watercraft hull is shown partially and is identified generally by the reference numeral 11. Only a portion of the hull 11 is depicted because the invention deals primarily with the propulsion unit for the hull and the actual hull configuration utilized may be of any of a wide variety of types.

Basically, the hull 11 is comprised of a hull underside portion 12 which in the illustrated embodiment has a modified V-bottom configuration. In this embodiment, the hull 11 is propelled by means of a pair of propulsion units, each indicated generally by the reference numeral 13.

Each propulsion unit 13 is comprised of a powering internal combustion engine, indicated generally by the reference numeral 14, and which is positioned forwardly of a rear bulkhead 15 of the hull portion 12. Although the engines 14 may be of any known type, the invention has particular utility in conjunction with four-cycle, internal combustion engines having wet sump lubrication systems for the reasons previously noted. Because of this, the construction of each engine 14 will be described only generally because it is believed that those skilled in the art will readily understand how the invention can be employed in conjunction with a wide variety of types of engines, bearing in mind the fact that the invention is intended primarily, but not solely, for use with four-cycle, wet sump engines.

Each engine 14 is comprised of a cylinder block 16 in which a plurality of cylinder bores are formed. Although the invention is described in conjunction with a multiple cylinder engine and in-line engines are depicted, it will be apparent to those skilled in the art how the invention can be employed with engines having other cylinder numbers and other cylinder configurations.

A cylinder head assembly 17 is affixed to the cylinder block 16 and closes the cylinder bores and defines combustion chambers. In the illustrated embodiment, the engines 14 are overhead valve engines and accordingly, an exhaust system that includes an exhaust manifold 18 is affixed to one side of each cylinder head 17 in registry with the exhaust ports formed therein. The exhaust manifolds 18 collect the exhaust gases and discharge them to the atmosphere through exhaust systems which will be described later.

In a like manner, an induction system is also provided for each engine which includes an intake manifold 19 which is, in the illustrated embodiment, affixed to the opposite side of the cylinder heads 17 from the exhaust manifolds 18. Atmospheric air is delivered to the intake manifold 19 from an area to the rear of the bulkhead 15 where it is collected with an inlet device 21 which may include a spark arrestor and filter and silencing arrangement, if desired. An intake pipe 22 extends from the intake device 21 through the bulkhead 15 and communicates with an inlet portion 23 of the respective intake manifold 19.

A crankcase assembly 24 is affixed to the lower side of the cylinder block 16 and contains a reservoir for oil for each of the engines. This crankcase member 26 encloses a crankcase chamber in which a crankshaft (not shown) rotates about an axis indicated by the line CA.

Each engine 14 is provided with an overhead valve mechanism that is contained within and operated by a suitable timing drive from the crankshaft. This valve actuating mechanism is enclosed within a valve chamber closed by valve covers 25 that are affixed to the cylinder heads 17 in a known manner.

The crankshaft has a portion 26 that extends outside of the main engine body and which is journaled for rotation in a bearing assembly 27 carried at the forward side of the bulkhead 15.

This portion 26 provides a connection between each engine 17 and a respective jet propulsion unit, indicated generally by the reference numeral 28 which forms the remainder of each propulsion unit 13. The jet propulsion units 28 are mounted behind the bulkhead 15 and in a relatively shallow tunnel formed by a raised under portion 29 of the hull portion 12.

Figure 3:
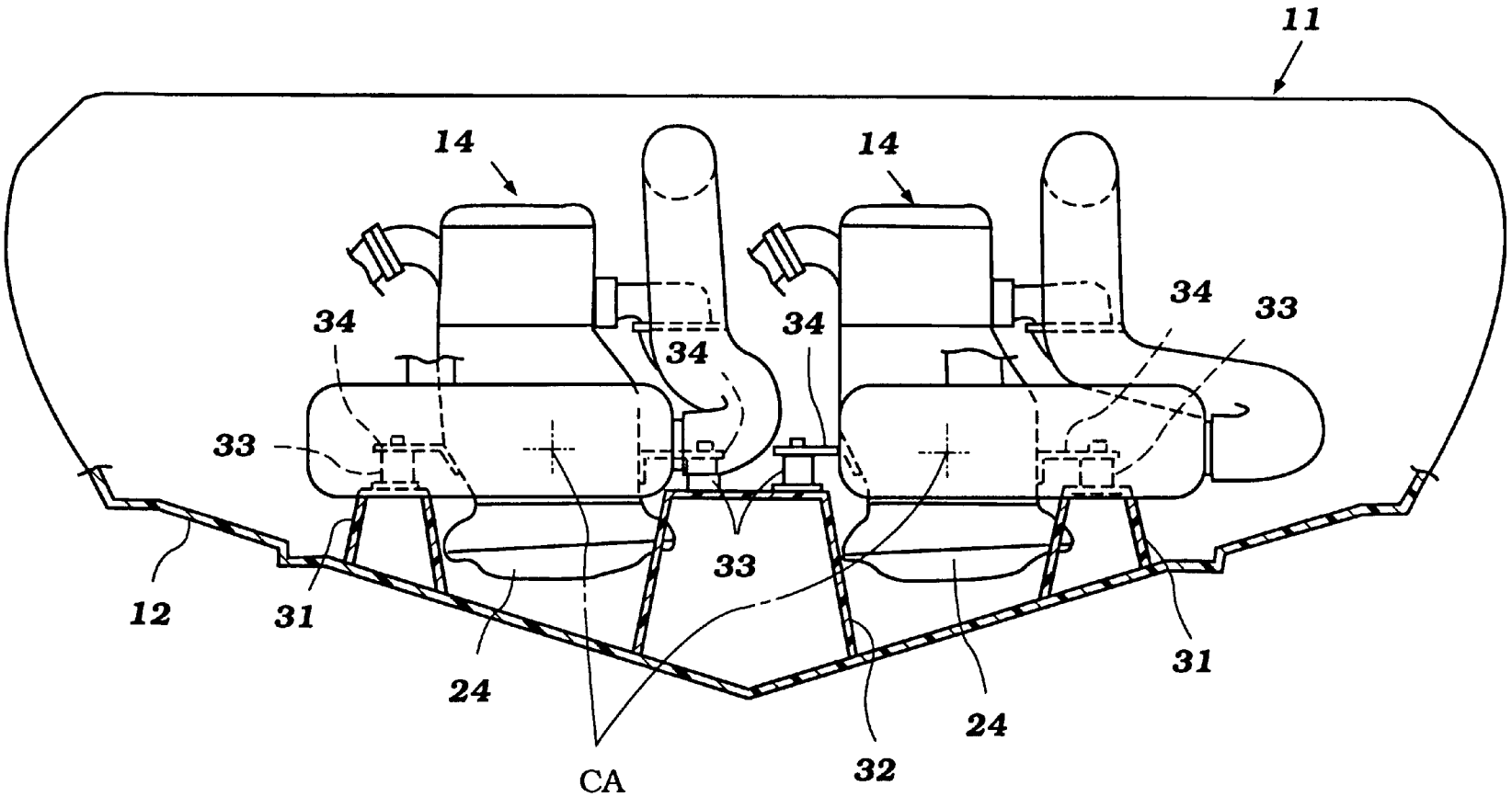
FIG. 3 is a cross-sectional view taken generally along a plane parallel to the plane of the bulkhead separating the engines from the jet propulsion units and looking toward the engines.

As may be best seen in FIG. 3, each engine 14 is mounted on a cradle assembly that is formed by a pair of outwardly spaced pillar portions 31 which may be formed integrally with or as separate elements affixed to the hull under portion 12. In addition, a common center pillar section 31 extends upwardly at the V-bottom of the hull 12 and provides a common support for both engines 14.

Elastic isolators 33 are interposed between the respective pillars 31 and 32 and mounting brackets 34 fixed suitably to a component of the respective engine. As may be seen also in this figure, this places the crankcase assemblies 24 above the hull undersurface and in an area between the pillars 31 and 32 where they may be conveniently accessed for servicing.

Referring again to the construction of the jet propulsion units 28, the portion of the hull between the main lower portion 12 and the raised portion 29 is provided with a further recessed area 35, the lower end of which is closed by a support member 36. The support member 36, in turn, defines a water inlet opening 37 by means of a grilled portion. Hence, the hull portion 35 and the supporting member 36 define a water inlet 38 through which water is drawn in a manner which will be described.

Figure 4:
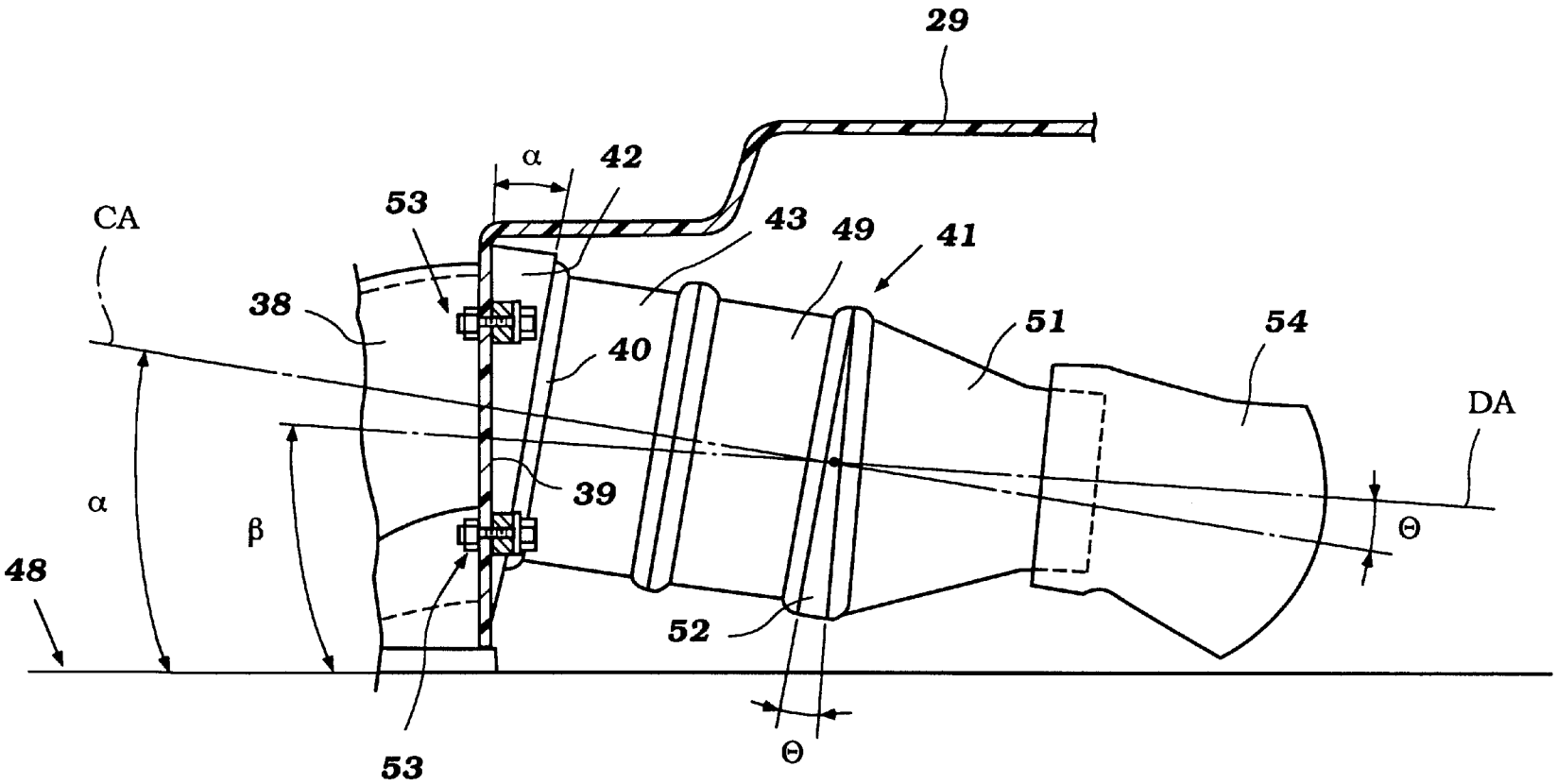
FIG. 4 is an enlarged view showing the components of the jet propulsion unit at the rear thereof to indicate the angle of the various components and the mounting thereof in the hull.

The hull is also provided with a generally vertically extending portion 39 to which a jet propulsion unit outer housing assembly, indicated generally by the reference numeral 41, is affixed (see primarily FIG. 4). This housing assembly 41 includes an inlet portion 42 having a rear flange 40 that extends at an angle $\alpha$ to the hull portion 39 and which merges into an impeller portion 43 in which a pump impeller 44 is journaled in a suitable manner. The pump impeller 44 is affixed to an impeller shaft 45 that extends forwardly through the water inlet opening 38.

Figure 2:
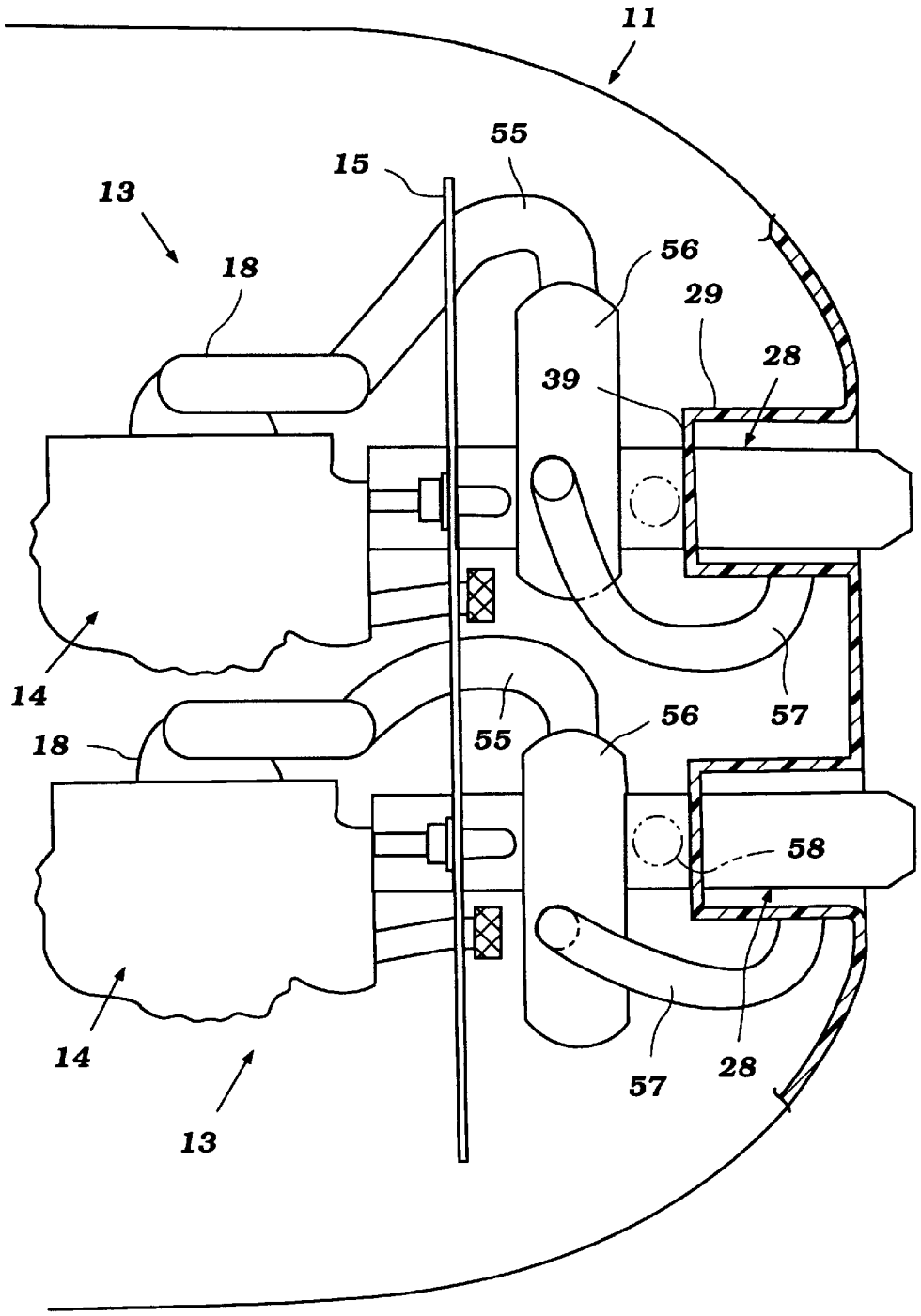
FIG. 2 is a top plan view of the portion of the watercraft shown in FIG. 1 with the hull broken away in part to show the propulsion unit arrangement and its relation to the hull components.

The impeller shaft 39 further extends forwardly through a tubular housing portion 46 (FIGS. 1 and 2) which spans the hull portion 35 and the bulkhead 15. The impeller shaft 45 also extends forwardly through the bearing 27 for connection to the crankshaft 26 by means of a connector 47, which may include a torsional damper. Thus, the impeller shaft 45 and rotational axis of the impeller 44 is parallel to and coincident with the crankshaft axis CA. This axis lies at an acute angle $\alpha$ to a horizontally extending undersurface 48 of the hull under portion 12 which is the same as the angle of the flange 40. This is a fairly steep acute angle so as to cause the engines 14 to be mounted well above the floor and offer adequate clearance for the crankcases 24 so as to contain adequate oil for the engine lubrication for a long period of time.

Rearwardly of the impeller portions 43, the outer housing 41 of the jet propulsion units 28 are provided with a further housing section 49 in which straightening vanes (not shown) are provided. This section is connected to a discharge nozzle 51 by a bridging section 52 that has a somewhat pie shape. Thus, the discharge nozzle portion 51 has a flow axis DA which lies at a small angle to the crankshaft axis CA and nearly parallel to the hull under surface plane 48. The angle to the hull under surface 48 is a very small acute angle $\beta$ so as to provide the desired trim characteristics when propulsion forces are being exerted.

Thus the angle of the discharge nozzle flow axis DA relative to the crankshaft and impeller housing axes CA is the angle $\theta$ which is a relatively small acute angle. This is the same angle as the shape of the pie shape connecting section 52 of the outer housing.

As may be seen in FIG. 4, the jet propulsion unit housing assembly 41 is affixed to the vertically extending portion 39 of the hull by threaded fastener assemblies 53.

A steering nozzle 54 is journaled for pivotal movement about a vertically extending axis to the discharge nozzle portion 51. The steering nozzles 54 are steered in a manner known in the art so as to provide directional control for the watercraft 11.

The exhaust system which communicates with the exhaust manifold 18 will now be described. This includes an exhaust pipe 55 which extends from each exhaust manifold 18 rearwardly and through the bulkhead 15. This pipe 55 connects to a respective water lock 56, which, in turn, has a discharge pipe 57 that extends from the side opposite where the exhaust pipe 55 enters and terminates within the recessed area where the jet propulsion units 28 are provided, which is defined by the hull portions 29 and 39.

Clean out devices shown in phantom and identified by the reference numerals 58 may be provided in the jet propulsion unit housing assembly that is formed by the hull portion 35. By removing a clean out plug (not shown), a person may place his hand into the water inlet opening 38 and remove foreign materials that may become clogged in the impeller 44 or on the impeller shaft 39.

Thus, from the foregoing description, it should be readily apparent that the propulsion system is such that the engine can be mounted high enough in the hull to permit a large oil capacity for servicing while, at the same time, insuring that the discharge nozzle angle is appropriate for the desired trim effect. Of course, the foregoing description is that of a preferred embodiment of the invention, and various changes and modifications may be made, as will become apparent to those skilled in the art, without departing from the spirit and scope of the invention, as defined by the appended claims.

What is claimed is:

1. A jet propulsion unit for powering a watercraft, said jet propulsion unit including an outer housing having an impeller portion in which an impeller rotates about an impeller shaft axis downwardly inclined relative to a horizontal line from a forwardly disposed driving engine toward the rear of the watercraft, said outer housing also defining a discharge nozzle to the rear of said impeller portion through which the water pumped by said impeller is discharged for propelling the watercraft, a line passing coaxially through the center of said discharge nozzle and the axis of rotation of said impeller shaft intersecting each other at an angle with the line passing through said discharge nozzle center having a substantially lesser angle to the horizontal line than the impeller axis.

2. A jet propulsion unit as set forth in claim 1 wherein the impeller portion and the discharge nozzle of the outer housing are joined by a pie shaped housing portion having an angle equal to the angle between the center of the discharge nozzle and the impeller shaft axis.

3. A jet propulsion unit as set forth in claim 1 wherein the impeller housing is affixed to a mounting section at its inlet end, said mounting section having a pie shape disposed at an angle to a vertical plane less than the angle between the center of the discharge nozzle and the impeller shaft axis.

4. A jet propulsion unit as set forth in claim 3 wherein the impeller portion and the discharge nozzle of the outer housing are joined by a pie shaped housing portion having an angle equal to the angle between the center of the discharge nozzle and the impeller shaft axis.

5. A jet propelled watercraft having a hull, a jet propulsion unit mounted by said hull and comprised of an outer housing having an impeller portion in which an impeller rotates about an impeller shaft axis and a discharge nozzle portion to the rear of said impeller portion through which the pumped water is discharged for propelling said watercraft, a forward portion of said outer housing impeller portion being fixed to a generally vertically extending wall at a rear portion of said hull with said discharge nozzle portion extending rearwardly of said vertically extending hull wall and generally horizontally, an engine positioned forwardly of said vertically extending wall and having an output shaft that drives said impeller shaft through a transmission, said impeller shaft axis and the axis of said discharge nozzle being disposed so that said impeller shaft axis is inclined upwardly toward the front of said watercraft relative to said discharge nozzle axis.

6. A jet propelled watercraft as set forth in claim 5 wherein the angle of the center of said discharge nozzle portion and the impeller shaft axis are not coaxial.

7. A jet propelled watercraft as set forth in claim 6 wherein the impeller portion and the discharge nozzle of the outer housing are joined by a pie shaped housing portion having an angle equal to the angle between the center of the discharge nozzle and the impeller shaft axis.

8. A jet propelled watercraft as set forth in claim 6 wherein the impeller housing is affixed to the vertically extending wall by a mounting section at its inlet end, said mounting section having a pie shape disposed at an angle to a vertical plane less than the angle between the center of the discharge nozzle and the impeller shaft axis.

9. A jet propelled watercraft as set forth in claim 8 wherein the impeller portion and the discharge nozzle of the outer housing are joined by a pie shaped housing portion having an angle equal to the angle between the center of the discharge nozzle and the impeller shaft axis.

10. A jet propelled watercraft as set forth in claim 5 wherein the engine is a four cycle, wet sump engine.

11. A jet propelled watercraft as set forth in claim 5 wherein the hull has a generally horizontally extending portion extending rearwardly from the vertically extending wall and overlying at least the impeller portion of the outer housing.

12. A jet propulsion unit for powering a watercraft, said jet propulsion unit including an outer housing having an impeller portion in which an impeller rotates about an impeller shaft axis, said outer housing also defining a discharge nozzle to the rear of said impeller portion through which the water pumped by said impeller is discharged for propelling the watercraft, the angle of the center of said discharge nozzle and the axis of rotation of said impeller shaft are not coaxial, said impeller portion and said discharge nozzle of said outer housing being joined by a pie shaped housing portion having an angle equal to the angle between said center of said discharge nozzle and said impeller shaft axis.

13. A jet propulsion unit for powering a watercraft, said jet propulsion unit including an outer housing having an impeller portion in which an impeller rotates about an impeller shaft axis, said outer housing also defining a discharge nozzle to the rear of said impeller portion through which the water pumped by said impeller is discharged for propelling the watercraft, the angle of the center of said discharge nozzle and the axis of rotation of said impeller shaft are not coaxial, said impeller portion of said outer housing being affixed to a mounting section at its inlet end, said mounting section having a pie shape disposed at an angle to a vertical plane less than the angle between the center of said discharge nozzle and said impeller shaft axis.

14. A jet propulsion unit as set forth in claim 13 wherein the impeller portion and the discharge nozzle of the outer housing are joined by a pie shaped housing portion having an angle equal to the angle between the center of the discharge nozzle and the impeller shaft axis.

* * * * *